US005957455A

United States Patent [19]

Aldridge

[11] Patent Number: 5,957,455

[45] Date of Patent: Sep. 28, 1999

[54] CONCEALED CHESS GAME

[76] Inventor: Chester P. Aldridge, 3 Circle Dr., Apt. B, Tiburon, Calif. 94920

[21] Appl. No.: 09/013,615

[22] Filed: Jan. 26, 1998

[51] Int. Cl.[6] ..... A63F 3/02

[52] U.S. Cl. ..... 273/260; 273/261

[58] Field of Search ..... 273/260, 261, 273/262

[56] References Cited

U.S. PATENT DOCUMENTS

| | | | |
|---|---|---|---|
| 1,141,909 | 6/1915 | D'Autremont | 273/261 |
| 1,312,315 | 8/1919 | Emmons . | |
| 1,492,071 | 4/1924 | Cornell et al. . | |
| 3,779,554 | 12/1973 | Brix . | |
| 4,005,866 | 2/1977 | Marcil . | |
| 4,089,529 | 5/1978 | Usami | 273/282 |
| 4,379,555 | 4/1983 | Dean | 273/236 |
| 4,982,965 | 1/1991 | Dozorsky | 273/262 |
| 5,388,837 | 2/1995 | Hoffman | 273/262 |
| 5,690,334 | 11/1997 | Duke | 273/261 |
| 5,692,754 | 12/1997 | Rostami | 273/261 |
| 5,735,523 | 4/1998 | Fioriglio | 273/261 |

OTHER PUBLICATIONS

Instruction Booklet for the STRATEGO ® game, Milton Bradley Company © 1986, 1996.

*Primary Examiner*—Sebastiano Passaniti

*Attorney, Agent, or Firm*—Intellectual Property Law Group; Otto O. Lee

[57] ABSTRACT

A strategy game involving traditional chess skills, decision-making and memorization, comprising a playing surface of checkered squares and concealed game pieces. Each player moves the game pieces similar to the corresponding rules of the traditional chess games with the object to capture an opponent's concealed game pieces.

20 Claims, 1 Drawing Sheet

CONCEALED CHESS GAME

BACKGROUND

This invention relates generally to board games with concealed game pieces that combine the skills of strategy and memory, and specifically relates to the popular chess game.

In a conventional chess game, two players battle against each other on a sixty-four squares checkered board using sixteen chess pieces—one king, one queen, two rooks, two bishops, two knights and eight pawns respectively. This game has been played for centuries by millions of people worldwide. The traditional chess game is one of strategy through predicting an opponent's future movements of the chess pieces in order to plan the attacking and defensive positions accordingly, to ultimately corner an opponent's king chess piece.

However, the chess game does not challenge the players' memory of the previous movements or the current location of an opponent's chess pieces because all the chess pieces are simply in plain view. Therefore, a player with superior strategy and experience will always prevail against one with less experience. In order to level the playing field, and allow the less experienced players to become more competitive, there is a need of a new game that the players may not be able to view their opponents' chess pieces. Consequently, the memorization of the previous movements and the location of an opponent player's chess piece will become crucial to win the game. In other words, a player with superior memory, though not as skillful in strategy as the other player, may still prevail in this game which combines the skills of memory and strategy.

In addition, the initial placement of the chess pieces in a traditional chess game is fixed which limits the potential number of possible layouts. More experienced chess players generally recognize some of the most popular or traditional gambits or chess piece layouts as employed by other master chess players. However, if the chess pieces are concealed, and if the initial placement of the chess pieces may be varied, the traditional layouts will not apply and a less experienced player who is not familiar with such traditional strategies will not suffer from such a disadvantage. In such a game, a player will not be able to see the location of the king game piece of an opposing player. Hence it will be crucial for a player to remember the movements of the opponent's game pieces in order to deduce and locate the king chess piece to win the game.

To further challenge the master chess players or train to improve one's chess skills, it will also be highly desirable to have a game where even one's own game pieces are not viewable by the player after the initial placement, thereby making the traditional chess game even more challenging. This will force the players to form a mental picture in addition to looking at the concealed game pieces on the chessboard.

Also it will be desirable to add barriers to the game such that certain squares on the playing surface will be occupied and causes blocking passage of other chess pieces to enhance the enjoyment of such game variation.

Thus, there is a need for a game that combines the skills of chess strategy and the memorization of an opponent's game pieces. Furthermore, there is a need for a game where the initial placements of the game pieces are not fixed thereby allowing the game to have numerous different variations and less predictability.

SUMMARY

The present invention satisfies these needs. This invention is a strategy game of memorization and skills comprising a horizontal playing surface of checkered squares, game pieces with two opposing sides and a base. The first side of the game pieces comprises a chess figure, and the second side of the game piece is opaque such that the chess figure on the first side is not viewable from the second side. The base firmly supports the game piece on the horizontal playing surface. Players place the game pieces on the horizontal playing surface and move each game piece containing the chess figure on the first side according to chess game rules. The first player to capture or corner an opposing player's predetermined game piece wins the game.

In a preferred embodiment, the initial placement of the game pieces is fixed according to the initial placement position of a chess game.

In another preferred embodiment, all the game pieces are covered after the initial placement, such that no game pieces are viewable throughout the strategy game.

In yet another preferred embodiment, the initial placement of the game pieces on the playing surface is conducted randomly by the drawing of the game pieces.

In yet another preferred embodiment there is at least one barrier game piece, whereby at least one player may place the barrier game piece on the playing surface to prevent landing or passage through the square on the playing surface.

In another preferred embodiment a player has an option to cheat by not moving a concealed game piece according to corresponding chess game rule. However, an opposing player may immediately inspect to reveal such game piece. If such a game piece found to have moved not according to the corresponding chess game rule, it is immediately removed from the playing surface. However, if the revealed game piece was confirmed to have moved according to the corresponding chess game rule, the player conducting the inspection will forfeit one game piece as chosen by the opposing player.

In yet another embodiment, the playing surface is in a square shape of eight horizontal rows and eight vertical columns of checkered squares.

In another preferred embodiment, the mode of playing is in electronic format such that a player may play against an opposing player by computer network, or a virtual player played by the computer.

Therefore the present invention satisfies the long felt need of a strategy game that would enhance chess playing skills by challenging one's memory, and at the same time level the playing field to enhance the possibilities of a less experienced chess player to win and enjoy the game.

DRAWINGS

These and other features, aspects, and advantages of the present invention will be better understood from the following drawings, description and appended claims, where:

FIG. 1 is a pictorial view of the thirty-six (36) game pieces disclosed in this invention showing a first side, a second side and a base.

DETAILED DESCRIPTION OF THE INVENTION

Figure 1:
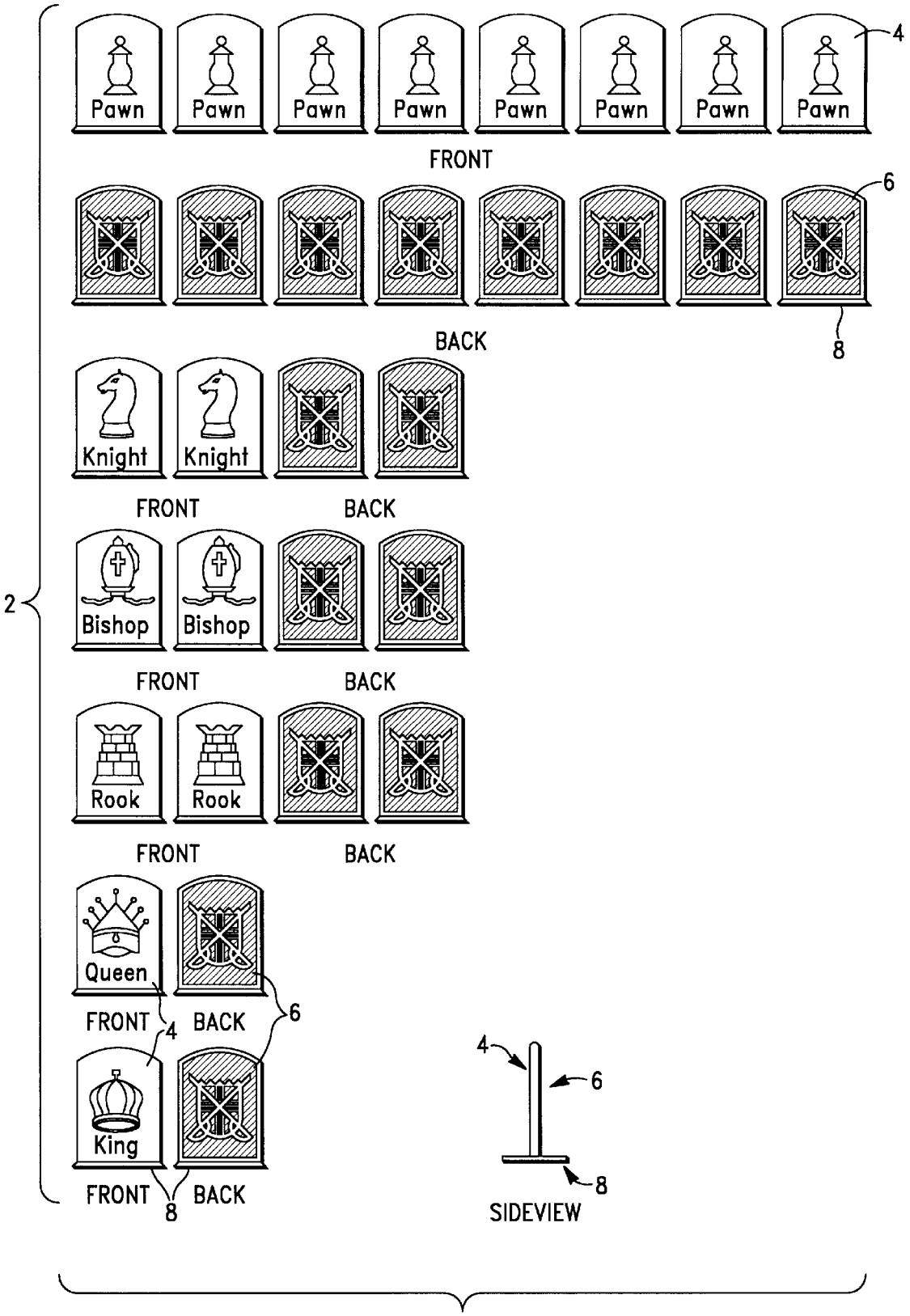

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a game set containing a substantially horizontal playing surface, preferably with at least thirty-two (32) game pieces 2. The playing surface may be made of any substantially horizontal surface, with checkered squares for the placement of the game pieces. Each game piece, which may be made of any number of substantially hardened and opaque material (such as plastic, wood or cardboard) has two sides. Each game piece has a graphical representation of the chess pieces (i.e. king, queen, knight, rook, bishop or pawn) on a first side 4. On a second side 6 of the game piece, it may contain solid colors or a design pattern. Each game piece is supported by a base 8 such that the elements on the first side cannot be viewed from the second side. A graphical representation of the game pieces is shown in FIG. 1. Therefore a player may be able to view the player's own game pieces from one side, but the player's opponent will not be able to view those game pieces from the other side.

In a first preferred embodiment, the common eight-by-eight (8×8) black and white chessboard is used as the playing surface. A plurality of players, preferably two or more, will place their own game pieces according to traditional chess rules along the first two rows of the playing surface closest to each player, enabling each player to view the chess graphical representation of the player's own game piece. Each player will play the concealed chess game by moving the game pieces according to the traditional chess rules. This game may be played similar to a traditional chess game until the king game piece is being cornered, or checkmate. Preferably, since the king game piece is not viewable by a player's opponent, there is no need to call "check" when an opponent's king game piece is under direct attack. Hence, a player may win the game by simply capturing the king chess piece by surprise, without necessarily cornering the king game piece for a checkmate as in a traditional chess game.

In a second preferred embodiment, it is designed for advanced and experienced chess players. The game is played similar to that of the first preferred embodiment, except that the first side of the game pieces are faced down, such that after the initial placement, none of the players may view the first side of all the game pieces, including one's own game pieces. In this manner, the players are challenged to use their memory of the previous movements of all the game pieces on the board to play the game. If a player suspects that the opposing player has moved a game piece not in accordance to the chess rules (or illegal move), the opposing player may request an "inspection" to review that game piece. If the inspection reviewed that the move were in fact illegal, the game piece would be removed from the board and the player calling the inspection would have the next move. On the other hand, if the inspection reviewed that the move were not illegal, the player whose game piece was inspected could choose to remove any one game piece from the player's opponent. The object of this game is to checkmate, attack by surprise, or remove the opponent's king game piece.

In yet another embodiment, each player may freely place the game pieces anywhere on the playing surface (instead of according to traditional chess rules). Hence, the player may place one's own game pieces anywhere along the first two rows, or any corresponding orientation on the playing surface agreed by the players. The game pieces will be moved according to chess rules and the object of the game is the same. Since the initial placement is varied, a player will not know the location of the opposing player's king game piece, and one will have to use memory of previous moves to deduce or guess the opponent's pieces. An interesting strategy available is that one may try to guess the location of the king by concentrating all the "firepower" to attack that location of the playing surface, similar to a "bonsai" attack. If this initial guess were correct, it would be very difficult for even the best chess player to defend against such a concentrated attack. Therefore, even a novice chess player will stand a chance to win against a very good chess player.

In another preferred embodiment, the player may place one's own game pieces anywhere along the first two rows (or any corresponding orientation on the playing surface) as explained in the previous embodiment. However, each player has the option to "cheat" by moving the game piece in the manner of another chess piece (e.g. moving a knight game piece as a bishop game piece). The opposing player may immediately review a suspected piece by performing an "inspection" as described above. If the move were indeed illegal, the inspected game piece would be removed from the playing surface. Otherwise, the inspected player may choose to remove any one game piece that belongs to the inspecting player. The goal of the game may be the capture of one's opponent's king game piece. However, alternatively the object of the game is to capture all the opponent's game pieces.

In yet another preferred embodiment, one or more game pieces acting as barriers are available to be placed by the players prior to or during the game on the playing surface to enhance the excitement and increase the number of varieties of the game.

What is claimed is:

1. A strategy game of memorization and skill comprising:

a) a substantially horizontal playing surface containing a plurality of checkered squares;

b) a plurality of game pieces, each game piece having two opposing sides and a base, wherein the first side comprises a chess figure, wherein the second side of the game piece is opaque such that the chess figure on the first side is not viewable from the second side, wherein the base firmly supports the game piece on the horizontal playing surface;

wherein at least one player places the game pieces on the horizontal playing surface, wherein each player moves each game piece containing the chess figure on the first side according to chess game rules, such that the first player to capture or corner an opposing player's predetermined game piece wins the game.

2. The strategy game according to claim 1, wherein the initial placement of the game pieces is fixed according to the initial placement positions of a chess game.

3. The strategy game according to claim 2, whereby the first side of all the game pieces are covered by placing the game pieces with the first side facing down onto the playing surface, with the second side facing up after the initial placement, such that the first side of the game pieces are not viewable throughout the strategy game.

4. The strategy game according to claim 1 whereby the initial placement of the game pieces on the playing surface is conducted randomly by the drawing of the game pieces.

5. The strategy game according to claim 1, further comprising at least one barrier game piece, whereby at least one player may place the barrier game piece on the playing surface to prevent landing or passage through the square on the playing surface.

6. The strategy game according to claim 2, further comprising at least one barrier game piece, whereby at least one player may place the barrier game piece on the playing surface to prevent landing or passage through the square on the playing surface.

7. The strategy game according to claim 3, further comprising at least one barrier game piece, whereby at least one player may place the barrier game piece on the playing surface to prevent landing or passage through the square on the playing surface.

8. The strategy game according to claim 4, further comprising at least one barrier game piece, whereby at least one player may place the barrier game piece on the playing surface to prevent landing or passage through the square on the playing surface.

9. The strategy game according to claim 1, whereby the mode of playing is in electronic format such that a player may play against an opposing player by computer network.

10. The strategy game according to claim 1, whereby the mode of playing is in electronic format such that a player may play against a virtual opposing player played by the computer.

11. The strategy game according to claim 1, wherein a player may cheat by not moving a game piece according to corresponding chess game rule, wherein an opposing player may immediately reveal such game piece, such that a game piece found to have moved not according to corresponding chess game rule is immediately removed from the playing surface;

wherein if the revealed game piece was confirmed to have moved according to chess game rule, the player conducting inspection will forfeit one game piece as chosen by the opposing player.

12. The strategy game according to claim 11, wherein the initial placement of the game pieces is fixed according to the initial placement positions of a chess game.

13. The strategy game according to claim 12, whereby the playing surface is in a square shape, further comprises of eight horizontal rows and eight vertical columns of checkered squares.

14. A strategy game combining elements of skill and memorization comprising:

a) a substantially horizontal playing surface with a plurality of checkered squares in a plurality of rows and columns;

b) a plurality of game pieces with different distinguishing features for each player, which comprises
i) at least one king;
ii) at least one queen;
iii) a plurality of rooks;
iv) a plurality of knights;
v) a plurality of bishops;
vi) a plurality of pawns;

whereby each player across from each other places the game pieces in the first and second rows of the playing surface in any manner, whereby each player moves the pieces according to chess game rules, such that the first player to capture or corner an opposing player's king game piece wins the game.

15. The strategy game according to claim 14, further comprising at least one barrier game piece, whereby at least one player may place the barrier game piece on the playing surface to prevent landing or passage through the square on the playing surface.

16. A two-player strategy game combining elements of skill and memorization comprising:

a) a substantially horizontal playing surface with eight horizontal rows and eight verticals columns of sixty-four checkered squares;

b) a plurality of game pieces with different distinguishing features for each player, the game pieces of each player comprise two opposing sides, the second side is opaque, and the first side comprises:
i) one king,
ii) one queen,
iii) two rooks,
iv) two knights,
v) two bishops, and
vi) eight pawns;

c) at least one non-movable barrier game piece, whereby at least one player may place the barrier game piece on the playing surface to prevent landing or passage through the square on the playing surface;

wherein the first side of the game pieces is concealed from an opposing player;

whereby each player across from each other may place the game pieces belonging to the player in the first and second rows of the playing surface in any manner, whereby each player may move the pieces according to chess game rules, such that the first player to capture or corner an opposing player's king game piece wins the game.

17. The strategy game according to claim 16, whereby the initial placement of the game pieces is fixed according to the initial placement positions of a chess game.

18. The strategy game according to claim 16, wherein a player may cheat by not moving a game piece according to corresponding chess rule, wherein an opposing player may immediately reveal such game piece, such that a game piece found to have moved not according to chess rule is immediately removed from the playing surface;

wherein if the revealed game piece was confirmed to have moved according to chess rules, the player conducting inspection will forfeit one game piece as chosen by the opposing player.

19. The strategy game according to claim 18, wherein the first player to capture all game pieces of an opposing player wins the game.

20. The strategy game according to claim 9, wherein the number of players is four.

* * * * *